United States Patent [19]

Tominaga et al.

[11] 3,974,617

[45] Aug. 17, 1976

[54] DOUBLE SHELL TANK CONSTRUCTION METHOD

[75] Inventors: Makoto Tominaga, Tokyo; Yuji Takeuchi, Yokohama; Takanori Kimura, Tokyo; Shinya Nakano; Nobumi Karasuno, both of Yokohama; Hiroshi Takeuchi, Konosu, all of Japan

[73] Assignee: Ishikawajima-Harima Jukogyo Kabushiki Kaisha, Tokyo, Japan

[22] Filed: May 15, 1974

[21] Appl. No.: 470,328

[30] Foreign Application Priority Data

Dec. 17, 1973 Japan ..... 48-142271

[52] U.S. Cl. ..... 52/741; 52/745; 52/247

[51] Int. Cl.[2] ..... E04B 1/00

[58] Field of Search ..... 52/745, 747, 245, 247, 52/249, 741, 749, 126; 226/9 A, 68

[56] References Cited

UNITED STATES PATENTS

| | | | |
|---|---|---|---|
| 3,057,054 | 10/1962 | Barnes | 52/741 X |
| 3,130,488 | 4/1964 | Lindstrom | 52/745 X |
| 3,268,999 | 8/1966 | Wiggins | 52/745 X |

*Primary Examiner*—Ernest R. Purser
*Assistant Examiner*—Carl D. Friedman
*Attorney, Agent, or Firm*—Scrivener Parker Scrivener & Clarke

[57] ABSTRACT

A double shell tank construction method is disclosed which comprises the steps of assemblying outer shell bottom and side plates, assemblying within the assembled outer shell an upper roof and an inner roof into a unitary construction, lifting the assembly of the inner and outer roofs to a predetermined height along the inner wall of the assembled outer shell, constructing a ring-shaped concrete, inner bottom plate foundation and arranging and disposing bottom heat insulation members within the ring-shaped foundation, assemblying an inner shell bottom plate over the ring-shaped concrete foundation and the bottom heat insulating members, and assemblying an inner shell by using the assembled outer shell.

7 Claims, 14 Drawing Figures

FIG. 3A
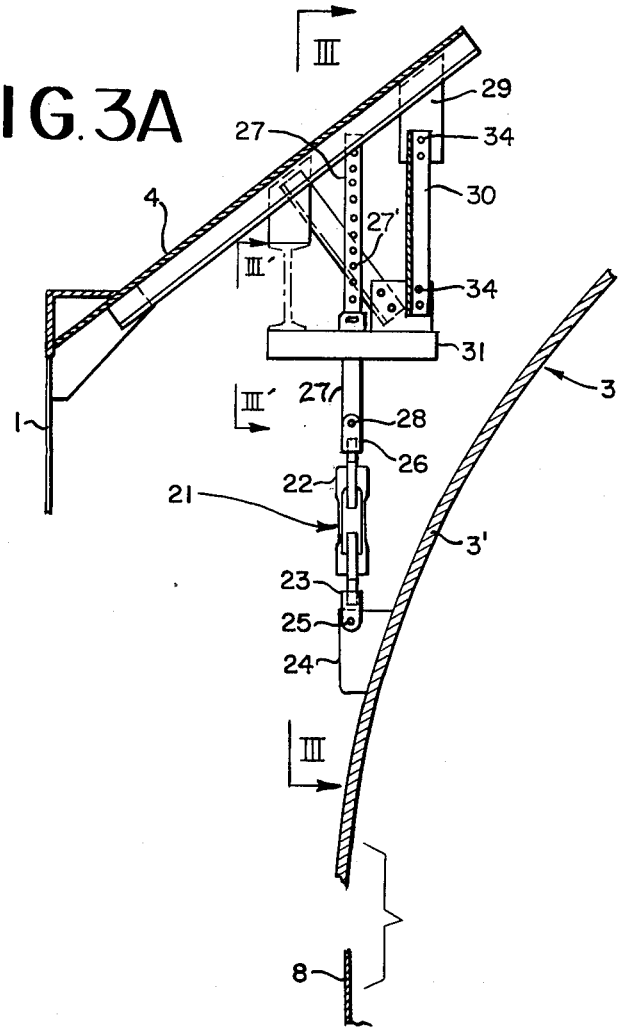
FIG. 3B
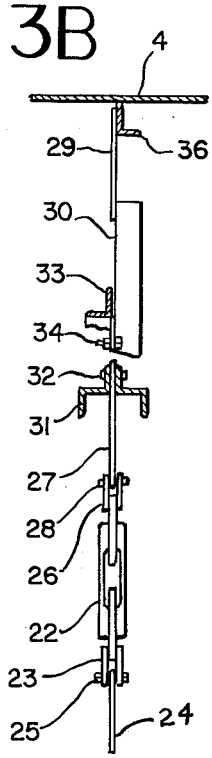
FIG. 3C
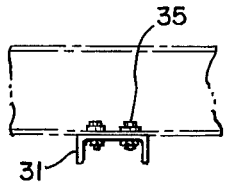
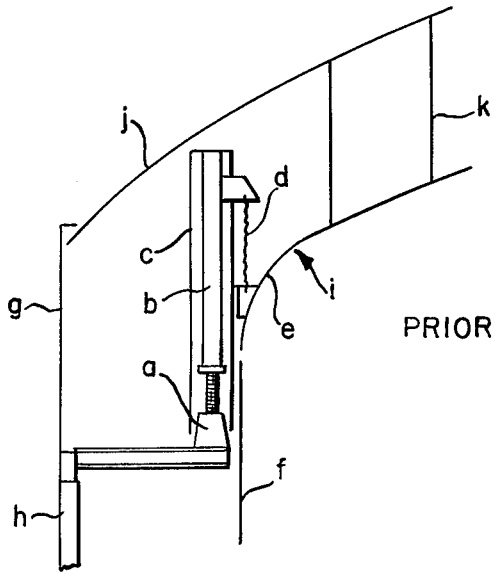
FIG. 4
PRIOR ART

DOUBLE SHELL TANK CONSTRUCTION METHOD

The present invention relates to a method for constructing double shell tanks and devices therefor.

In the prior art double shell tank construction methods, an inner shell is first assembled and then an outer shell is assembled. Thereafter an inner roof and an outer roof are assembled into a unitary construction within the assembled outer shell, and the assembly of the inner and outer roofs is lifted along the inner wall of the inner shell so that the inner and outer roofs may be joined to the tops of the inner and outer shells, respectively. Therefore, the welding of the inner shell, which is the most important step in the double shell tank assembly, is carried out outside, that is, without any protection so that the progress of the inner shell assembly is considerably dependent upon the weather conditions. As a result, if the rain continues, the construction or assembly of the tank is much delayed. To overcome this problem, a temporary roof must be provided.

When the double shell tank construction method which floats or lifts the assembly of the inner and outer roofs along the inner wall of the assembled inner shell is used, the latter, which must be kept intact from the standpoint of the mechanical strengths, tends to be damaged. Furthermore, the prior art double shell tank construction methods generally use large-sized hoising machines with the result of the increase in assembly cost.

One of the objects of the present invention is therefore to provide an improved double shell tank construction method in which floating of an outer and inner roofs as well as assembly of an inner shell may be carried out in a simple manner and within a short time by using the outer shell first assembled.

Another object of the present invention is to standardize the method for assemblying the outer and inner roofs of the double shell tanks so that the assemblying method may be simplified and the assemblying cost may be reduced.

The above and other objects, features and advantages of the present invention will become more apparent from the following description of preferred embodiments thereof taken in conjunction with the accompanying drawings.

Figure 1A:
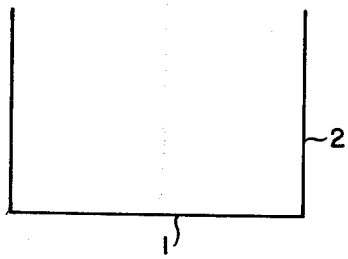
Figure 1B:
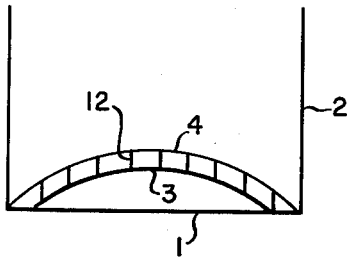
Figure 1C:
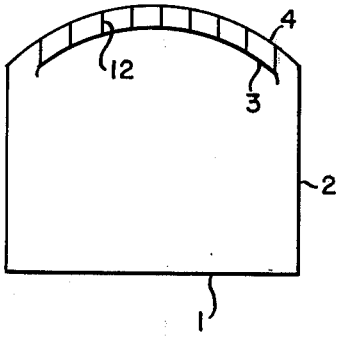
Figure 1D:
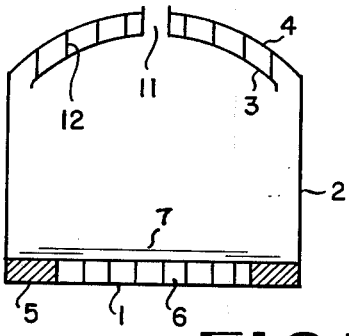
Figure 1E:
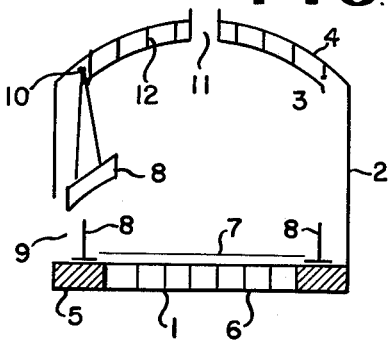

FIGS. 1 A – E are sectional views of a double shell tank used for the explanation of a first embodiment of a double shell tank construction method in accord with the present invention, FIG. 1 A showing a step in which an outer bottom and an outer shell have been assembled, FIG. 1 B, a step in which an outer roof and an inner roof are assembled into a unitary construction within the outer shell, FIG. 1 C, a step in which the roof assembly has been lifted along the inner wall of the outer shell to the top thereof, FIG. 1 D, a step in which an inner bottom plate is laid over heat insulation members and a ring-shaped bottom concrete foundation and FIG. 1 E, a step for assemblying the structural members of an inner shell.

Figure 2A:
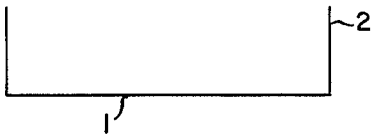
Figure 2B:
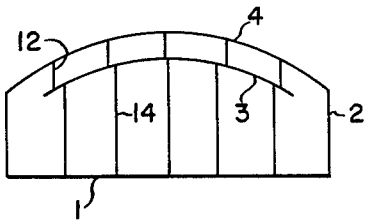
Figure 2C:
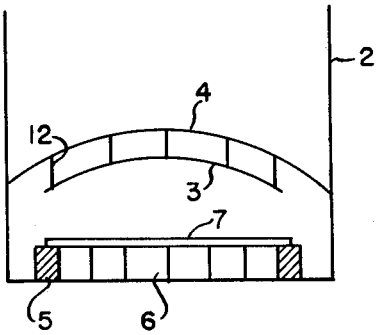
Figure 2D:
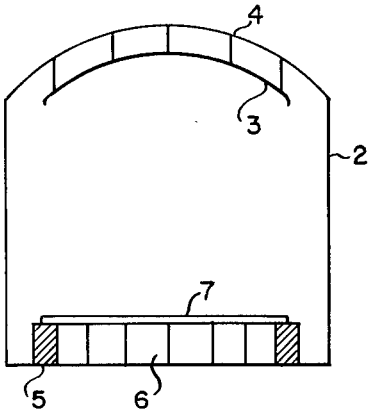
Figure 2E:
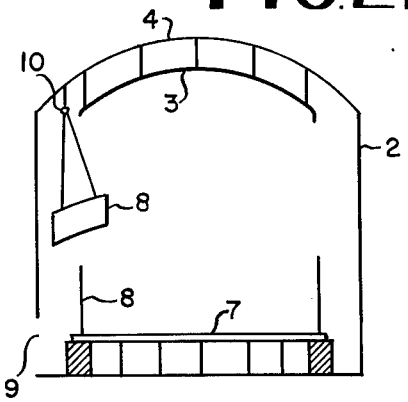

FIGS. 2 A – E are sectional views of a double shell tank being assembled used for the explanation of a second embodiment of the present invention, FIG. 2 A showing a step in which an outer shell bottom and lower side plates of an outer shell are assembled, FIG. 2 B, a step in which an outer roof and an inner roof are assembled into a unitary construction within the lower outer shell, FIG. 2 C, a step in which supports of the roof assembly are removed, the roof assembly is supported by the outer shell by suitable temporary supporting means, and an inner bottom is laid over heat insulating members and a ring-shaped concrete foundation upon the outer shell bottom while the complete outer shell is assembled, FIG. 2 D, a step in which the roof assembly is lifted along the inner wall of the outer shell, and FIG. 2 E, a step for assemblying an inner shell.

FIGS. 3 A – C show one embodiment of a device for assemblying a roof assembly used in conjunction with the double shell tank construction methods in accordance with the present invention, FIG. 3 A being a front view thereof partly in section, FIG. 3 B, a side view looking in the direction indicated by the arrows III in FIG. 3 A, and FIG. 3 C, a side view looking in the direction indicated by the arrows III′ in FIG. 3 A.

FIG. 4 is a view used for the explanation of the prior art double shell tank construction method.

Prior to the description of the preferred embodiments of the present invention, a prior art double shell tank construction method will be briefly described with reference to FIG. 4 so that the defects of the prior art method, which the present invention contemplates to overcome, may be more particularly pointed out.

The prior art method for assemblying a roof of a double shell tank uses a jack of the type shown in FIG. 4. After an inner roof *i* and an outer roof *j*, which are joined to each other through brackets *k* as a unitary construction, have been floated the outer roof *j* is securely joined to an outer shell *g*. Thereafter, a plurality of jacks *a* are mounted on a working platform *h* constructed along the inner wall of the outer shell *g* so that the inner roof *i* may be lifted or supported by the jacks *a*. Next the brackets *k* are cut off, and the jacks *a* are gradually actuated so that the inner roof *i* may be slowly lowered to rest upon the upper end of an inner shell *f*. Thereafter, the inner roof *i* is joined to the inner shell *f* by welding.

In FIG. 4, *b* denotes an inner tube; *c*, a sleeve; *d*, a wire rope; and *e* a knuckle plate.

The prior art roof assemblying method of the type described has however many defects. First, the construction of the working platform *h*, upon which are mounted the jack *a*, requires much materials material (steels) and much labor. Second, the steps of the assembly are complex. Third, the assembly takes a long time.

Referring to FIGS. 1 A – E, according to the first embodiment of the present invention, first an outer bottom 1 and an outer shell 2 are assembled. Thereafter, an inner roof 3 is assembled upon the outer bottom 1, and then an outer roof 4, which is spaced apart from the inner roof 3 by a predetermined distance by brackets 12, is assembled. The assembly of the inner and outer roofs 3 and 4 is lifted along the inner wall of the outer shell 2 under pressurized air. In order to discharge the pressurized air used to float the roof assembly, it is preferable to provide a vent hole 11 through the roof assembly. Thereafter, a ring-shaped concrete foundation 5 is formed upon the outer shell bottom 1, and bottom heat insulating members 6 are arranged and disposed within the foundation 5. Thereafter, an inner bottom plate 7 is laid over the ring-shaped concrete foundation 5 and the bottom heat insulating members 6.

Thereafter, a small-sized hoisting machine such as a trolley hoist 10 is mounted upon the assembled outer shell 2 so that a structual member 8 of the inner shell may be lifted for assembly. An opening 9 is formed through the outer shell 2 in order to bring the assembly materials and equipments into or out of the outer shell 2.

In summary, the outer shell is assembled upon the outer shell bottom plate, and the assembly of the outer and inner roofs are assembled upon the outer shell bottom plate. Thereafter, the roof assembly is floated by forcing the pressurized air into the outer shell, and securely fixed to the outer shell. The ring-shaped concrete foundation for the inner shell bottom is constructed upon the outer shell bottom plate, and the bottom heat insulating members are arranged and disposed within the ring-shaped concrete foundation. Thereafter, the inner shell is assembled. Therefore, the inner bottom plate and the inner shell cannot be assembled before the ring-shaped concrete foundation is laid and the bottom heat insulating members are disposed.

According to the second embodiment of the present invention, the assembly time may be much reduced than that of the first embodiment.

Referring to FIGS. 2 A – E, the outer shell bottom 1 and the outer shell 2 are assembled upon a tank foundation. Next, supports 14 are erected upon the outer shell bottom plate 1 so that the inner roof 3 may be assembled upon the supports 14 and spaced apart from the bottom plate 1 by a suitable distance which may permit the smooth assembly works within the outer shell 2. Thereafter, the outer roof 4 is assembled and joined by the brackets 12 to the inner roof 3 so that the unitary roof assembly may be formed.

Next, the roof assembly 3, 4 is supported by the outer shell 2 with suitable temporary supporting means (not shown), and then the supports 14 are removed. Thereafter, the ring-shaped inner bottom concrete foundation 5 is formed, and the heat insulating members 6 are disposed within the ring-shaped foundation 5 while the upper outer shell is assembled or extended.

After the outer shell 2 has been completely assembled, the roof assembly 3, 4 is disconnected from the outer shell 2 and is floated toward the top of the outer shell by forcing the pressurized air into the outer shell 2.

The small-sized hoisting machine such as a trolley hoist 10 is mounted upon the assembled outer shell 2 so that the structural members 8 of the inner shell 2 may be lifted for assembly. The working opening 9 is also formed through the outer shell 2.

When the inner roof 2 is assembled by the methods of the present invention described hereinbefore with reference to FIGS. 1 and 2, an inner roof assemblying device shown in FIGS. 3 A – C is used.

The outer portion of the outer roof 4 and the knuckle plate 3′ of the inner roof 3 are interconnected by an inner roof lifting or supporting device generally indicated by 21. Furthermore, the center portions of the outer and inner roofs 4 and 3 are also joined together by lifting or supporting means such as brackets (not shown).

The adjustable inner roof lifting or suspending device 21 includes a turnbuckle 22 whose lower square screw rod is joined with a bolt and nut 25 to a bracket 24 which in turn is securely fixed to the knuckle plate 3′ of the inner roof 3. An upper square screw rod 26 of the turnbuckle 22 is joined with a bolt and nut 28 to an adjusting pin plate 27 suspended from the outer roof 4. As described above, the structural members are joined with the bolts and nuts (pin joints) so that the lateral movement of the inner roof may be permitted.

The adjusting pin plate 27, which is provided with a row of bolt holes 27′, is supported with a bolt and nut 32 by a reinforcing channel 31 which in turn is suspended from the outer roof 4 through a bracket 29 and an angle 30. In FIG. 3, reference numeral 33 denotes a rafter; 34, bolts and nuts; 36, a rafter attached to the outer roof 4; 1, an outer shell plate; and 8, an inner shell plate.

In assembly, the roof assembly consisting of the inner and outer roofs 3 and 4 connected to each other by the brackets and the inner roof lifting or suspending devices 21 of the type described above, is floated so that the outer roof 4 may be joined to the outer shell 1. After the inner side shell plates 8 have been assembled, the turnbuckle 22 is rotated so that the inner roof 3 may be lifted. Thereafter, the lifting or supporting members such as brackets interconnecting the center portions of the inner and outer roofs 3 and 4 are removed. Thereafter, the turnbuckles 22 are rotated in the reverse direction so that the inner roof 3 may be lowered 20 to 30 mm until the knuckle plate 3′ of the inner roof 3 abuts against the inner side shell plate 8. Thereafter, the knuckle plate 3′ is joined to the inner shell plate 8 by welding, and then the inner roof lifting or suspending devices 21 are disassembled, and removed out of the double shell tank.

In the instant embodiments, in addition to the inner roof lifting or suspending devices 21, additional lifting or supporting means such as brackets are used, but it is to be understood that the latter may be eliminated when the mechanical strengths of the inner roof lifting devices may be sufficiently increased.

The advantages of the double shell tank construction methods in accord with the present invention may be summarized as follows:

I. The welding operations, which are most important in the assembly of the double shell tanks, may be carried out within the outer shell regardless of the weather conditions so that the assembly time may be considerably reduced. Especially according to the construction method described with reference to FIGS. 2 A – E, the assembly of the outer shell as well as the construction of the ring-shaped concrete foundation and the assembly of the bottom heat insulating members may be simultaneously carried out so that the assembly time may be further reduced. Moreover, unlike the construction method described with reference to FIGS. 1 A – E, the assembly works may be carried out at lower positions so that the accidents may be prevented.

II. The roof assembly of the outer and inner roofs is floated upwardly along the inner wall of the outer shell so that any damages to the inner shell plates which impair the mechanical strengths thereof may be prevented.

III. Hoisting and assembling of the inner shell plates may be carried out by a small-sized hoisting machine so that the assembly cost may be considerably reduced.

IV. The bottom heat insulating members may be assembled within the outer shell regardless of the weather conditions so that they may be satisfactorily protected from moisture.

V. The double shell tank construction time may be considerably reduced.

VI. The inner roof suspending devices in accord with the present invention may be standardized with the result of the saving both of the materials and labors.

The assembly steps at the fields may be also considerably reduced in number.

VII. The inner roof suspending devices of the present invention are considerably simple both in construction and in operation. The fatigue of the assembly men may be much relieved. Furthermore, the inner roof suspending devices may be used in assembly of double shell tanks similar in construction, and because of the pin joints of the inner roof lifting or suspending devices, the movement of the inner roof is permitted during assembly so that the roof assembly may be remarkably facilitated. Furthermore, the standardization of the inner roof lifting or suspending devices may permit the standardization of the assembly steps with the result of labor saving.

What is claimed is:

1. A double shell tank construction method comprising the steps of assemblying an outer shell bottom plate and outer shell plates to form an outer shell, assemblying an outer roof and an inner roof into a unitary construction within the assembled outer shell, lifting said assembly of said outer and inner roofs and securing the outer roof to the top of said assembled outer shell, forming a ring-shaped inner bottom concrete foundation upon said outer shell bottom plate and then disposing bottom heat insulating members within said ring-shaped foundation, assemblying an inner bottom plate over said ring-shaped foundation and said bottom heat insulating members, and thereafter assemblying within the assembled outer shell, inner shell plates to form an inner shell upon said inner bottom plate.

2. A double shell construction method as defined in claim 1 wherein said inner and outer roofs are assembled upon said outer shell bottom plate in spaced apart relation with respect to said outer shell bottom plate, thereafter forming a ring-shaped concrete foundation upon said outer shell bottom plate while the outer shell is assembled, disposing bottom heat insulating members within said concrete foundation and thereafter lifting the assembly of said inner and outer roofs by forcing pressurized air into said assembled outer shell.

3. A double shell tank construction method as defined in claim 2 wherein an opening is formed through the outer shell so that materials required for the assembly of the inner shell may be brought into the outer shell through said opening.

4. A double shell tank construction method as defined in claim 3 and wherein a trolley hoist is used to transport inner shell plates into the outer shell.

5. A double shell tank construction method as defined in claim 2 wherein said inner and outer roofs are joined to each other through a plurality of inner roof lifting devices adapted to cause said inner roof to be lowered toward the top of the assembled inner shell so as to be joined thereto.

6. A double shell tank construction method as defined in claim 5, wherein said inner and outer roofs are joined to each other with a plurality of inner roof lifting devices and lifting brackets; and when said inner roof is joined to the inner shell, said lifting brackets are cut off and removed and said inner roof is lowered to be joined to said inner shell by means of said inner roof lifting devices.

7. A double shell tank construction method as defined in claim 5 wherein each of said plurality of inner roof lifting devices includes a turnbuckle adapted to lift or lower said inner roof.

* * * * *